United States Patent [19]

Matsumoto

[11] 4,053,152

[45] Oct. 11, 1977

[54] SHEET FEEDING DEVICE

[75] Inventor: Osamu Matsumoto, Ebina, Japan

[73] Assignee: Rank Xerox, Ltd., London, England

[21] Appl. No.: 709,157

[22] Filed: July 27, 1976

[30] Foreign Application Priority Data

Oct. 16, 1975 Japan ..... 50-140026[U]

[51] Int. Cl.[2] ..... B65H 1/02

[52] U.S. Cl. ..... 271/9; 271/8 A; 271/118; 271/145

[58] Field of Search ..... 271/8 A, 9, 117, 118, 271/126, 127, 145, 146, 149, 160

[56] References Cited

U.S. PATENT DOCUMENTS

| | | | |
|---|---|---|---|
| 1,152,358 | 8/1915 | Reifsnyder et al. | 271/149 |
| 3,618,933 | 11/1971 | Roggenstein et al. | 271/126 |
| 3,689,064 | 9/1972 | Kuksa et al. | 271/127 X |
| 3,756,586 | 9/1973 | Craft | 271/126 X |

*Primary Examiner*—Robert W. Saifer

[57] ABSTRACT

A sheet feeding apparatus for feeding a sheet from a stack thereof includes a feeder for engaging a first portion of the stack. Apparatus are provided for supporting the stack including a mechanism for fanning out the first portion of the stack. The fanning out mechanism includes a member arranged for movement between first and second positions. In the first position the member is operable during sheet feeding for supportingly engaging the first portion of the stack against a contact force of the feeder. In the second position, the member is disengaged from the stack to allow it to fan out. Preferably, the stack is supported in a generally vertical orientation.

5 Claims, 1 Drawing Figure

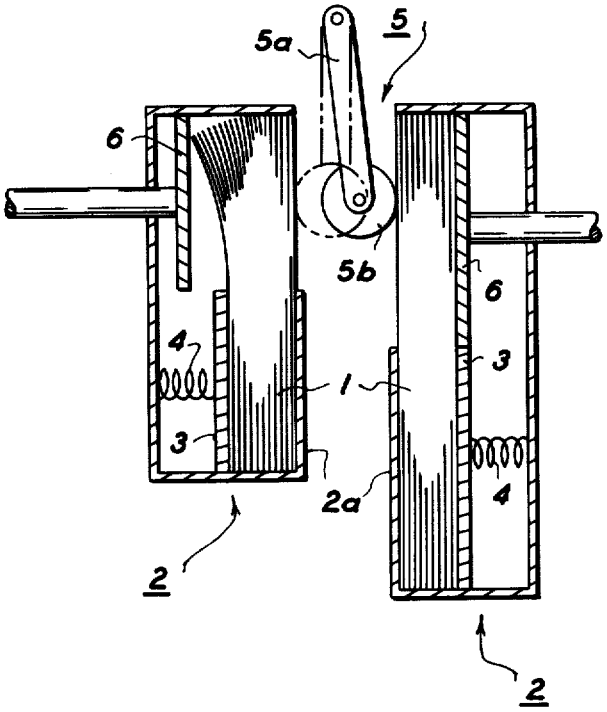
5a
5
6
5b
6
4
3
1
3
2a
4
2
2

SHEET FEEDING DEVICE

BACKGROUND OF THE INVENTION

This invention relates to a sheet feeding apparatus which can feed paper sheets or the like, sheet by sheet from a stack thereof. The sheet feeding apparatus is useful in copiers, printing presses, and the like.

In conventional paper feeding devices a stack of paper is horizontally supported, and hence, it is difficult for air to enter between the respective sheets in the stack. Since the top sheet is in intimate contact with the next adjacent sheet, there is a potential for double feeding.

SUMMARY OF THE INVENTION

In accordance with the present invention a sheet feeding apparatus for feeding a sheet from a stack thereof is provided which includes a means engaging a first portion of a stack for feeding a sheet from the stack. Means are also provided for supporting the stack of sheets wherein the support means includes a means for fanning out that first portion of the stack. The fanning out means includes a first means arranged for movement between first and second positions. The first means is operable in the first position during sheet feeding for supportingly engaging the first portion of the stack against a contact force of the feeding means. When the first means is in the second position it is disengaged from the stack to allow the stack to fan out.

Preferably the stack is supported generally vertically. Preferably, the fanning out means also includes means for restraining a second and different portion of the stack.

Accordingly, it is an object of this invention to provide a paper feed device which allows air to easily enter between sheets of paper or the like in a stack thereof to prevent the occurrence of double feeding.

These and other objects will become more apparent from the following description and drawings.

BRIEF DESCRIPTION OF THE DRAWINGS

The FIGURE is a sectional view showing an embodiment of a sheet feeding apparatus in accordance with the present invention.

DETAILED DESCRIPTION OF THE PREFERRED EMBODIMENTS

Referring now to the Figure, a stack of sheets of paper 1 is vertically supported between a longitudinal side wall 2a of a paper feed base 2 and a biasing longitudinal plate 3. The stack of paper 1 is urged and restrained by the biasing longitudinal plate 3 through a spring 4 so that the stack is pressed toward the longitudinal side wall 2a.

In the embodiment shown in the Figure, a pair of left and right paper feed bases 2, each receiving therein a stack of paper 1 of respectively different sizes are arranged opposite to each other. A paper feed member 5 which comprises a pivotable rotary arm 5a and a paper feed roller 5a mounted at the leading end of the rotary arm 5a is disposed between the stacks of paper supported in the left and right feed bases 2. The rotary arm 5a is selectively pivoted to the left or right, so that sheets of paper may selectively be fed upwardly sheet by sheet from either the left or right paper feed bases 2.

The biasing longitudinal plate 3 is about one-half the length of the stack of paper 1 and, therefore, engages only a portion of the stack. A movable longitudinal plate 6 is laterally movably mounted at the upper half portion of the stack of paper 1. When the movable longitudinal plate 6 is moved forwardly to engage the stack of paper 1, the stack is biased and retained in an upright fashion against a contact force of the paper feed roller 5b. When the movable plate 6 is withdrawn away from the stack of paper, namely, disengaged therefrom, the stack of paper fans out to provide easy entry of air between the respective sheets of paper in the stack.

In the illustrated embodiment, the paper feed roller 5b is shown as contacting the upper portion or surface of the stack of paper 1 having a large size. When the paper feed roller 5b is rotated counterclockwise, the leftmost sheet of paper is fed out of the base 2 in an upwardly direction. During the feeding the movable longitudinal plate 6 on the side of the stack of large size paper 1 is positioned leftwards as shown in the Figure to bias the stack of paper against the contact pressure of the paper feed roller 5b. The movable longitudinal plate 6 on the side of the stack of small size paper 1 is withdrawn leftwardly of the Figure so that the upper half portion of that stack is fanned out to allow air to easily enter between the sheets.

It is to be noted that movement of the movable longitudinal plate 6 may be accomplished by any desired conventional means in coordination with the rotation of the paper feed roller 5b or in coordination with rotation of the rotary arm 5a.

Where sheets of paper are fed from the stack of paper having a small size, the rotary arm 5a is rotated clockwise so that the paper feed roller 5b is brought into contact with the rightmost surface of the stack of paper having a small size. Simultaneously the paper feed roller 5b is rotated in a clockwise direction to feed a sheet from the stack. At this same time the movable longitudinal plate 6 on the side of the stack of paper having a small size is moved rightwardly toward the stack of paper to bias the stack against the contact pressure of the paper feed roller 5b. In this instance the movable longitudinal plate 6 on the side of the stack of paper having a large size is withdrawn rightward in the Figure away from the stack 1 whereby the upper half portion of the stack is fanned out to allow air to easily enter between the sheets of paper.

It will be appreciated that if the stack of paper 1 is received within the paper feed base 2 with the stack of paper slightly inclined toward the movable longitudinal plate 6, though still generally vertical, the upper half portion of the stack of paper can surely be fanned out when the movable longitudinal plate 6 is withdrawn to thereby provide more positive fanning out and ease of entry of air between the sheets of paper.

From the foregoing construction it will be appreciated that in accordance with the present invention except when a paper sheet is to be fed the movable longitudinal plate 6 is withdrawn to cause the upper portion of the stack of paper to fan out and thereby prevent the intimate contact between the sheets and allow easy entry of air to reduce the occurrence of double feeding.

What is claimed is

1. A sheet feeding apparatus for feeding a sheet from a stack thereof comprising:

means for feeding a sheet from said stack in an upwardly direction, said feeding means being arranged for movement between a first feeding position wherein it engages a first portion of said stack and is adapted to feed a sheet from said stack. and a second position spaced from said stack;

means for supporting said stack of sheets, in a generally vertical orientation so that said feeding means can feed said sheet from said stack in said upwardly direction;

said support means including means for fanning out said first portion of said stack;

said fanning out means including a first means arranged for movement between first and second support positions, said first means being operable in its first position to supportingly engage said first portion of said stack against a contact force of said feeding means, and said first means in its second position being disengaged from said stack to allow said stack to fan out;

said support means further including means for restraining a second portion of said stack different from said first portion, said restraining means being operable when said first means is in its first or second positions, said first portion of said stack being arranged upwardly of said second portion thereof;

whereby when said feeding means is in its second position and said first means is in its second position, said stack is fanned out to allow air to easily enter between the sheets.

2. An apparatus as in claim 1, wherein said first means is in said first position only during sheet feeding.

3. An apparatus as in claim 1, wherein said stack support means is arranged to support said stack so that it is inclined toward said first means, though still generally vertically oriented, whereby more positive fanning out of said sheets in said stack is provided.

4. An apparatus as in claim 1, including means for moving said first means to its first position in response to the movement of said feeding means to its first position in engagement with said stack.

5. An apparatus as in claim 1, further including second means for supporting a second stack of sheets in a generally vertical orientation and wherein said feeding means in its second position is arranged to feed a sheet from said second stack in an upwardly direction, said second support means including second means for fanning out a first portion of said second stack, said second fanning out means including a third means arranged for movement between third and fourth positions, said third means being operable in said third position for supportingly engaging said first portion of said second stack against a contact force of said feeding means during sheet feeding, said third means in said fourth position being disengaged from said second stack to allow said second stack to fan out, said feeding means being arranged to selectively engage either said first portion of said first stack or said first portion of said second stack, and wherein said first means and said third means are positioned in said first or third positions, respectively, when said feeding means engages its respective stack of sheets or in said second or fourth positions, respectively, when said feeding means is disengaged from its respective stack of sheets;

whereby when a sheet is being fed from one of said stacks, the sheets in the other of said stacks are fanned out to allow air to easily enter between the sheets.

* * * * *